US008654999B2

(12) United States Patent
Mindlin, II et al.

(10) Patent No.: US 8,654,999 B2
(45) Date of Patent: Feb. 18, 2014

(54) SYSTEM AND METHOD OF PROGRESSIVE HEARING DEVICE ADJUSTMENT

(75) Inventors: Harold S. Mindlin, II, Austin, TX (US); David Matthew Landry, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 296 days.

(21) Appl. No.: 13/085,016

(22) Filed: Apr. 12, 2011

(65) Prior Publication Data

US 2011/0249839 A1 Oct. 13, 2011

Related U.S. Application Data

(60) Provisional application No. 61/323,841, filed on Apr. 13, 2010, provisional application No. 61/305,759, filed on Jun. 2, 2010.

(51) Int. Cl.
*H04R 25/00* (2006.01)

(52) U.S. Cl.
USPC ..... 381/314; 381/60; 381/312

(58) Field of Classification Search
USPC ..... 381/314
See application file for complete search history.

(56) References Cited

U.S. PATENT DOCUMENTS

| | | | | |
|---|---|---|---|---|
| 5,202,927 | A * | 4/1993 | Topholm | 381/315 |
| 6,574,342 | B1 * | 6/2003 | Davis et al. | 381/314 |
| 2003/0215105 | A1 * | 11/2003 | Sacha | 381/312 |
| 2005/0036637 | A1 | 2/2005 | Janssen | |
| 2010/0246869 | A1 * | 9/2010 | Zhang et al. | 381/320 |

* cited by examiner

*Primary Examiner* — Duc Nguyen
*Assistant Examiner* — Taunya McCarty
(74) *Attorney, Agent, or Firm* — Lee & Hayes, PLLC

(57) ABSTRACT

A hearing aid includes a microphone to convert sound into an electrical signal and a processor coupled to the microphone. The processor is configured to apply a selected one of a sequence of incremental hearing corrections to the electrical signal to produce a modulated output signal to at least partially compensate for a hearing impairment of a user. The hearing aid further includes a speaker coupled to the processor and configured to convert the modulated output signal into an audible sound.

20 Claims, 4 Drawing Sheets

SYSTEM AND METHOD OF PROGRESSIVE HEARING DEVICE ADJUSTMENT

CROSS REFERENCE TO RELATED APPLICATION(S)

This application is a non-provisional of and claims priority to U.S. Provisional patent application No. 61/350,759, entitled "SYSTEM AND METHOD OF PROVIDING AN INCREMENTAL HEARING ADJUSTMENT FILTER," and filed on Jun. 2, 2010, which is incorporated herein by reference in its entirety. Further, this application is a non-provisional of and claims priority to U.S. Provisional patent application No. 61/323,841, entitled "SYSTEM AND METHOD OF PROGRESSIVE HEARING DEVICE ADJUSTMENT," and filed on Apr. 13, 2010, which is incorporated herein by reference in its entirety.

FIELD

This disclosure relates generally to hearing aid adjustments, and more particularly, to hearing aids, computer-readable media, and computing devices for incremental hearing aid adjustment.

BACKGROUND

Hearing deficiencies can range from partial hearing impairment to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

Hearing aids have been developed to alleviate the effects of hearing losses in individuals. Conventionally, hearing aids range from ear pieces configured to amplify sounds to configurable hearing devices offering adjustable operational parameters that can be configured by a hearing specialist to enhance the performance of the hearing aid. Parameters, such as volume or tone, often can be easily adjusted, and many hearing aids allow for the individual users to adjust these parameters. However, other parameters may only be adjusted by the audiologist or by another health professional.

In instances where the individual's hearing loss varies across frequencies, such hearing aids can be tuned by an audiologist, for example, to compensate for the unique variations of the individual's hearing loss. The audiologist or health professional typically takes measurements using calibrated and specialized equipment to assess an individual's hearing capabilities in a variety of sound environments, and then adjusts the hearing aid based on the calibrated measurements to compensate for the individual's hearing loss. Subsequent adjustments to the hearing aid can require additional measurements and further calibration, which can be costly and time intensive.

However, for some users, the transition from not wearing a hearing aid to wearing a hearing aid can be traumatic. In particular, sounds that the user is not accustomed to hearing can suddenly be made audible to the user by the hearing aid. Some individuals, such as those wearing hearing aids for the first time, can experience psychological distress when hearing is restored to a normal level after years of suffering from hearing loss. Due to such distress, the first time user may have a difficult time adjusting to the hearing aid, and may give up on hearing aids altogether.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a hearing aid and methods are described below that provide an incremental or progressive hearing adjustment for a user particularly for easing the transition from not wearing a hearing aid to wearing a hearing aid. In particular, rather than abruptly implementing the hearing correction for the user immediately, the hearing aid progressively applies incremental adjustments to progressively or gradually adjust the user's experience from an uncompensated hearing level to a fully compensated hearing level. Such incremental adjustments allow the user to become accustomed to the hearing compensation in small increments over time, thereby reducing the psychological and/or physical distress associated with an abrupt transition from uncompensated to corrected hearing.

Figure 2:
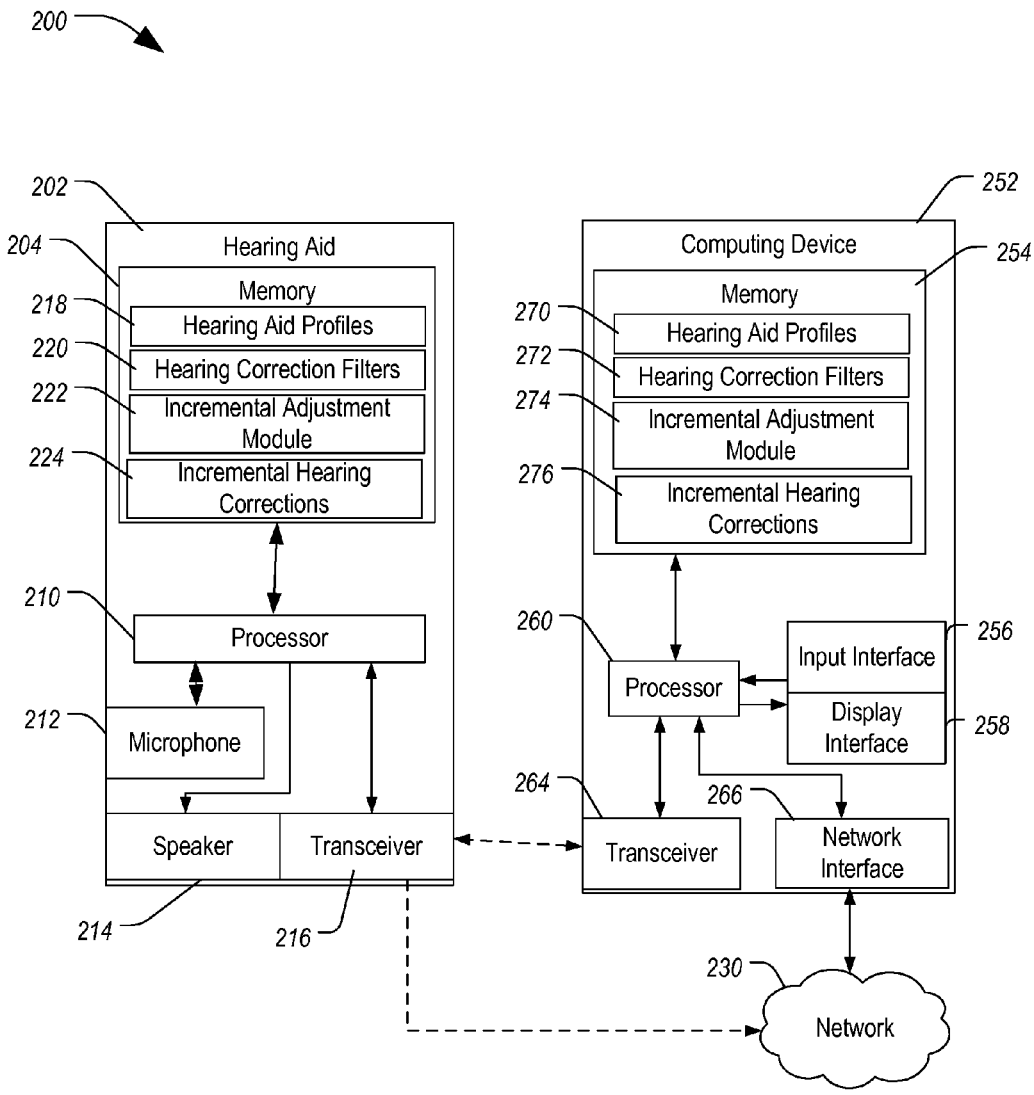
FIG. 2 is a block diagram of an embodiment of a hearing aid system for providing incremental hearing correction adjustments.

As used herein, the term "hearing aid profile" refers to a collection of acoustic configuration settings for a hearing aid, such as hearing aid 202 depicted in FIG. 2, which are used by a processor 210 (in FIG. 2) to shape acoustic signals to correct for a user's hearing loss. The shaped acoustic signals (or modulated output signals) are provided to a speaker or bone conduction element for reproduction for a user. Each of the hearing aid profiles are designed to compensate for the hearing loss of the user based on the user's particular hearing characteristics (impairment). In particular, processor 210 can apply a particular hearing aid profile that is customized for the particular user to compensate for hearing deficits of the user or otherwise enhance the sound-related signals. The hearing aid profile includes parameters that configure the hearing aid 202. For example, such parameters can include signal amplitude and gain characteristics, signal processing algorithms, frequency response characteristics, coefficients associated with one or more signal processing algorithms, or any combination thereof.

In some instances, one or more of the hearing aid profiles may also include filters and/or further adjustments configured to compensate the user's hearing impairment for a particular sound environment. In such instances, the hearing aid profile may be configured based on the user's hearing impairment and based on a particular environmental model.

As used herein, the term "hearing correction filter" refers to a collection of filters for hearing aid 202, which are applied by processor 210 within hearing aid 202 to a hearing aid profile to reduce the level of correction provided to the user by application of the hearing aid profile. The collection of hearing correction filters may include a series of hearing correction adjustments designed to be applied in a sequence over a period of time to provide incremental corrections for the user's hearing loss to ease the user's transition from uncompensated to corrected hearing. In such an instance, a first hearing correction filter attenuates the hearing aid profile by a pre-determined amount, limiting the adjustment provided by hearing aid 202. Each of subsequent hearing correction filter in the sequence increases the correction provided by (decreases the attenuation applied to) the hearing aid profile to some degree, until the sequence is complete and the hearing aid profile is fully applied to provide the desired hearing correction for the user. In an embodiment, an initial fitter may decrease the compensation to allow hearing aid 202 to provide almost no correction initially. In this instance, the selected hearing aid profile represents a desired hearing compensation. Processor 210 can implement an algorithm to dynamically generate a plurality of intermediate filters that can be applied over a period of time to ease the user's transition. Alternatively, such filters can be created by a hearing health professional.

Figure 1:
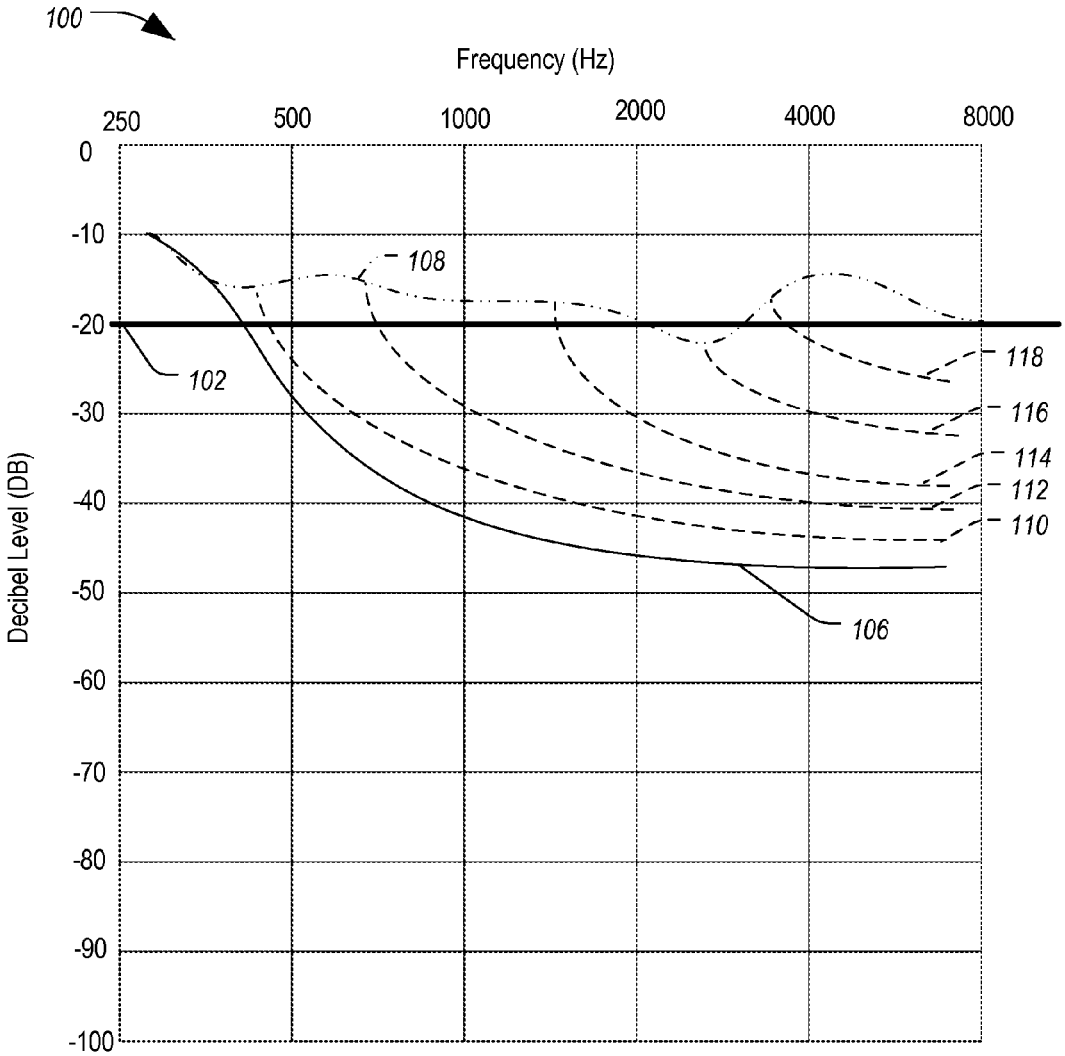
FIG. 1 is a graph illustrating a representative example of decibel level (in dB) versus frequency (in Hertz) for a representative hearing sensitivity threshold, a representative user's hearing deficit, and a series of incremental adjustments to advance the user's hearing from the user's hearing deficit level to an adjusted hearing level associated with a hearing aid profile.

As used herein, the term "incremental hearing correction" refers to a collection of acoustic configuration settings for hearing aid 202 (such as a hearing aid profile described above), which are used by processor 210 within hearing aid 202 to shape acoustic signals to correct for a user's hearing loss. Each of the incremental hearing corrections represents an intermediate hearing adjustment to provide a modulated output signal having a level that is within a range between an uncompensated output level and the desired output level. In one embodiment, the incremental hearing corrections can be formed by applying one or more hearing correction filters to a selected hearing aid profile to produce the intermediate hearing aid profiles. In another embodiment, the incremental hearing corrections can be programmed by a hearing health professional. In still another embodiment, the incremental hearing corrections can be calculated dynamically as a function of a difference in decibels between the uncompensated level and the desired output level. The incremental hearing corrections are selectively applied over a period of time based on the length of time the user has been using hearing aids. In another embodiment, the incremental hearing corrections include a series of hearing correction profiles designed to be applied in a sequence to provide incremental correction for the user's hearing loss. For example, the incremental hearing corrections are applied, one at a time for periods of time, to slowly adjust the hearing correction of the hearing aid until a desired hearing level is reached to allow time for the user to become accustomed to the corrected hearing level. In another example, incremental hearing corrections may be generated from a difference between a selected hearing aid profile and a level corresponding to no hearing correction using an algorithm for defining intermediate profiles based on a variable such as time or user-requested increments. FIG. 1 is a graph 100 of a representative example of decibel level (in dB) versus frequency (in Hertz) depicting an embodiment of a representative hearing sensitivity threshold, a representative user's hearing deficit, and a series of incremental adjustments to advance the user's hearing from the user's hearing deficit level to an adjusted hearing level associated with a hearing aid profile. A normal hearing sensitivity threshold is represented on the graph 100 by a straight line at a −20 dB level, which is generally indicated at 102. Any hearing sensitivity at or above hearing sensitivity threshold 102 would be considered "normal" on an audiogram. The user's actual hearing levels are represented on the graph 100 by a hearing loss line 106. Hearing loss line 106 represents a particular user's actual hearing sensitivity, i.e., the user's uncompensated hearing. Under normal operating conditions, hearing aid 202 (depicted in FIG. 2) would apply a selected hearing aid profile that is customized to compensate for the user's hearing impairment to correct the user's hearing so that the user's hearing sensitivity would correspond to hearing aid profile correction line 108. In other words, hearing aid profile correction line 108 represents a desired (final or fully compensated) hearing correction for the user, which can be achieved by applying a selected hearing aid profile to sound signals using a processor of a hearing aid.

The graph 100 also includes a plurality of intermediate hearing sensitivity levels that fall within a range between hearing loss line 106 and hearing aid profile correction line 108, which intermediate hearing sensitivity levels are achieved by applying hearing correction filters to the selected hearing aid profile and/or by applying incremental hearing corrections to the audio signal to provide incremental (progressive) hearing adjustments. Each of the intermediate hearing sensitivity lines 110, 112, 114, 116, and 118 represents one or more adjustments to enhance the user's hearing sensitivity by applying an incremental hearing filter the selected hearing aid profile, reducing its hearing correction by a predetermined amount. In the illustrated example, the plurality of incremental hearing corrections (or hearing correction filters) are applied in a sequence to produce hearing sensitivity lines 110, 112, 114, 116, and 118, over a period of time, gradually adjusting the hearing correction from the user's uncompensated hearing level at hearing loss line 106 to the desired hearing level represented by the hearing aid profile correction line 108.

in the illustrated example, the hearing sensitivity lines 110, 112, 114, 116, and 118 appear to indicate that the incremental hearing corrections adjust selected frequencies to the desired hearing level while providing less of an enhancement to other frequencies. However, it should be understood that other incremental hearing corrections could be used. For example, in one particular instance, the incremental hearing correction could dampen or otherwise apply filters to the selected hearing aid profile to incrementally adjust the hearing correction across the entire range of frequencies substantially evenly. In another instance, the incremental hearing correction could adjust selected frequencies by different amounts, providing a non-uniform hearing correction.

In a particular example, the user or an audiologist may select a hearing aid profile, such as the hearing aid profile associated with correction line 108, to configure a hearing aid, such as hearing aid 202 depicted in FIG. 2. The hearing aid profile is applied by a processor of the hearing aid to modulate the audio output signal to compensate for the user's hearing impairment represented by the user's hearing loss line 106, which indicates impairment of the user's acoustic sensitivity at higher frequencies. In conventional hearing aids, the hearing aid would immediately apply the hearing aid profile to correct the user's hearing up to hearing aid profile correction lien 108.

However, in embodiments of the hearing aid system described below, instructions executable by a processor of computing device 222, hearing aid 202, or another system may be used to produce multiple correction levels, which can be applied to the selected hearing aid profile, to make the hearing compensation more gradual to allow time for the user to become accustomed to the hearing aid and its audio compensation, easing the user into hearing aid by compensating the audio output a little bit at a time, reducing the potential shock from a drastic change in hearing conditions.

In this example, a first incremental hearing correction may be applied initially to provide a hearing sensitivity corresponding to intermediate hearing line 110. After a period of time has passed or a trigger is received, hearing aid 202 applies a second incremental hearing correction, resulting in correction up to a second intermediate hearing line 112, further increasing the users hearing experience. The hearing aid continues applying the incremental hearing corrections to provide progressively enhanced hearing sensitivity as indicated intermediate hearing lines 112 and 114 and so on until the desired correction level of the selected hearing aid profile is reached, as indicated by hearing aid profile line 108.

By gradually adjusting the hearing correction over time through the sequential application of incremental hearing corrections (or through sequential application of hearing correction filters to the selected hearing aid profile), the hearing aid allows the user to gradually become acclimated to each acoustic adjustment before a next adjustment is applied, increasing the likelihood that the user will accept and continue to use the hearing aid. It should be understood that graph 100 in FIG. 1 depicts only a few hearing sensitivity levels corresponding to a few incremental hearing corrections corresponding to increments up to a particular hearing aid profile; however, any number of increments may be provided, depending on a number of factors including the specific implementation, the magnitude of the difference between the user's hearing level 106 and the hearing aid profile line 108, a pre-configured setting, or any number of other factors. Further, hearing correction filters can be applied to each hearing aid profile to produce a plurality of incremental hearing corrections for a give hearing aid profile. Thus, in operation, if hearing aid is switched from a first hearing aid profile to a second hearing aid profile, the currently selected hearing correction filter can be applied to the second hearing aid profile to continue to provide the desired, gradually progressive hearing adjustment.

Additionally, it should be appreciated that graph 100 represents an illustrative example only, and that other hearing aid profiles and other, more complex, incremental hearing correction lines (patterns or curves) may be used. Further, it should be understood that the filter or correction used to achieve the correction lines and ultimately the hearing aid profile is composed of a plurality of coefficients, parameters, or other settings that are applied by a processor of the hearing aid to alter various characteristics of the sounds to modulate them to compensate for the user's hearing impairment.

FIG. 2 is a block diagram of an embodiment of a system 200 including a hearing aid 202 adapted to communicate with a computing device 252, either of which or both of which may be adapted to provide an incremental adjustment to a selected hearing aid profile. Hearing aid 202 includes a transceiver 216 that is configured to communicate with computing device 252 through a communication channel, which can be wired or wireless. In some instances, the communication channel can be a Bluetooth® communication channel. In some embodiments, transceiver 216 may be configurable to connect to a network 230 for receiving hearing aid profiles, filters, adjustment modules updates, incremental hearing corrections, other data, or any combination thereof. Hearing aid 102 also includes a processor 210 connected to transceiver device 216 and to a microphone 212 and a speaker 214. Hearing aid 202 further includes a memory 204 connected to processor 210 and configured to store processor executable instructions (signal processing instructions), parameter adjustment logic, one or more hearing aid profiles 218, one or more hearing correction filters 220, incremental adjustment logic 222, and incremental hearing corrections 224.

Computing device 252 is a personal digital assistant (PDA), smart phone, portable computer, tablet computer or other computing device adapted to send and receive radio frequency signals according to any protocol compatible with hearing aid 202. Representative examples of computing device 252 include the Apple iPhone®, which is commercially available from Apple, Inc. of Cupertino, Calif. and the Blackberry®, available from Research In Motion Limited of Waterloo, Ontario. Other types of mobile telephone devices with short range wireless capability can also be used.

Computing device 252 includes a transceiver 264, which is connected to a processor 260, such that processor 260 may send and receive data packets to and from hearing aid 202 via transceiver device 264. Processor 260 is connected to a display interface 258 for displaying information to a user and to an input interface 256 for receiving user input. In some embodiments, a touch screen display may be used, in which case display interface 258 and input interface 256 are combined. Computing device 252 further includes a network interface 266 that is configurable to connect to a network, such as the Internet. In an example, a user may interact with input interface 256 to cause computing device 252 to interact with the network, for example, to download hearing aid profiles, hearing correction filters, updated incremental adjustment instructions, and/or incremental hearing corrections from a remote device, such as a computer server.

Computing device 252 includes a memory 254, which is accessible by a processor 260, Memory 254 stores a plurality of instructions that are executable by processor 260, including graphical user interface (GUI) generator instructions. Memory 254 further includes a plurality of hearing aid profiles 270, hearing correction filters 272, incremental adjustment module 274, and incremental hearing corrections 276. Memory 254 may store a larger number of hearing aid profiles 270, hearing correction filters 272, and incremental hearing corrections 276 than memory 204, and processor 260 may selectively provide a desired hearing aid profile, hearing correction filter and/or incremental hearing correction to hearing aid 202 through the communication channel.

In an example, hearing aid 202 stores a selected hearing aid profile 218 and one or more hearing correction filters 220 in memory 204. In this instance, processor 210 selectively applies each a selected one of the hearing correction filters 220 to the selected hearing aid profile 218 to provide an incremental hearing correction for a period of time before advancing to a next incremental hearing correction by applying a next hearing correction filter 220 in a sequence. Thus, processor 210 selectively provides incremental hearing improvements to progressively enhance the user's hearing experience.

In a second example, hearing aid 202 stores the selected hearing aid profile 218 and one or more incremental hearing corrections 224. In this instance, processor selectively applies a selected one of the incremental hearing corrections 224 to provide an incremental hearing adjustment for a period of time before advancing to a next one of the incremental hearing corrections 224 in a sequence. Thus, processor 210 selectively provides incremental hearing improvements to progressively enhance the user's hearing experience.

In a third example, hearing aid 202 stores the selected hearing aid profile 218 and data related to the user's hearing impairment. During operation, processor 210 dynamically calculates a number of increments based on a difference between a normal hearing level and a hearing level associated with the user. The processor 210 then uses the number of increments to subdivide the difference into adjustment increments. Processor 210 can use the adjustment increments to dynamically generate incremental hearing corrections, each of which can be applied for a period of time before advancing to a next incremental hearing correction in a sequence. Thus, processor 210 selectively provides incremental hearing improvements to progressively enhance the user's hearing experience.

In a fourth example, hearing aid 202 receives a trigger from computing device 252 through the communication channel. In response to the trigger, processor 210 either selects an incremental hearing correction 224, selects a filter from hearing correction filters 222 for application to a selected hearing aid profile 218 to produce an incremental hearing correction, or extracts an incremental hearing correction from the trigger. Once the incremental hearing correction is determined, processor 210 applies the incremental hearing correction to modulate an output signal to a hearing sensitivity level that is between an uncompensated hearing level and a normal hearing level. Processor 210 may receive subsequent triggers and perform a similar operation to progressively advance the output level toward normal hearing levels.

Thus, hearing aid 202 eases the user into the desired hearing level provided by the selected hearing aid profile over a period of time, reducing the psychological shock to the user of an abrupt change and reducing the probability that the user will reject the use of hearing aids altogether. In an alternative example, processor 210 or 260 may begin with the user's hearing level and dynamically generate incremental hearing corrections until a level associated with a selected hearing aid profile is reached. By dynamically creating each of the incremental hearing correction profiles for easing the user into normal hearing levels, the memory consumption is reduced and a wider range of increments can be provided, that can be more narrowly tailored to the user's actual hearing ability.

In general, either hearing aid 202 or computing device 252 may monitor the incremental hearing corrections. In a first embodiment, processor 210 in hearing aid 202 will monitor a clock in hearing aid 202 and record the number of cycles in memory 204, thus establishing and tracking a time base. Once the number of dock cycles stored in memory 204 exceeds a preset limit (or threshold), processor 210 generates a trigger, causing processor 210 to apply a next hearing correction in the sequence and to reset the clock counter. In a second embodiment, processor 210 may generate a trigger based on a calendar, such as a number of hours, days, weeks, or a specific date. For example, processor 210 may generate a trigger every day, every week, every Tuesday, every 12 hours, or periodically with respect to some other time increment. The length of each period in this case could be programmed by the user using input interface 256 of computing device, providing more user-control and allowing the user to customize the adjustment process.

In an alternative example, processor 260 in computing device 252 generate triggers and send a signal including the trigger to hearing aid 202 through the communication channel, causing processor 210 to apply the incremental hearing correction profile. Processor 260 may, as described above with respect to processor 210, monitor a number of clock cycles during which hearing aid 202 is in use or use a calendar to determine when to generate a trigger for hearing aid 202, for example, based on numbers of days, weeks, hours, etc. By utilizing processor 260 instead of processor 210 in hearing aid 102, substantial processing and memory storage can be offloaded to computing device 252, saving space, battery life, and processing power for hearing aid 202. Further, processor 260 may provide the incremental hearing correction to hearing aid 202 as part of the trigger.

Additionally, computing device 252 may utilize display interface 258 and input interface 256 to allow a user to generate the trigger. In this embodiment, the user selects an icon, menu item, or other selectable element to launch an application that produces a graphical user interface (GUI) and provides it to display interface 258. The user interacts with the GUI through input interface 256 to cause computing device 252 to communicate the trigger to hearing aid 202 so that the hearing aid 202 applies the next incremental hearing correction.

As mentioned above, a trigger is a command executable by processor 210 of hearing aid 202, causing processor 210 to apply the next incremental hearing correction profile to shape sound. In some instances, the trigger may also include the incremental hearing correction to be applied. For example, if the incremental hearing corrections are stored in memory 254 on computing device 252, processor 260 may transmit a selected one of the incremental hearing corrections 276 to hearing aid 202 through the communication channel. Either hearing aid 202 or computing device 252 may keep a record of which incremental hearing correction is next in the sequence.

Once a trigger is received by hearing aid 202, processor 210 obtains the next incremental hearing correction either from hearing aid corrections 224 in memory 204 or from the trigger received from computing device 252. In some instances, hearing aid 202 may signal computing device 252 to retrieve the next incremental hearing correction from incremental hearing corrections 276 in memory 254. Once processor 210 has received the selected incremental hearing correction, processor 210 applies it to shape the sound input received from microphone 212 to produce a modulated output signal for reproduction for the user by speaker 214.

In general, system 200 is configurable to apply hearing aid corrections 224 and/or hearing aid corrections 276 received from computing device 252 over a period of time, with each progressive adjustment following an acclimation period for the user to become acclimated to the adjusted audio signal before a next progressive adjustment is applied. However, it should be appreciated that the incremental hearing corrections 224 or 276 within a sequence may not be uniformly distributed over the range of acoustic levels between the uncompensated hearing level and a normal hearing level. Further, the amount of time that a particular incremental hearing correction is applied before moving to the next incremental correction may also vary. In one instance, the amount of time is longer for larger incremental hearing corrections as compared to smaller incremental hearing corrections. In another instance, the amount of time becomes progressively shorter as the incremental hearing corrections approach the hearing correction provided by the selected hearing aid profile.

In a particular embodiment, incremental hearing corrections 224 and 276 are generated by applying hearing correction filters 222 and 274 to a selected one of hearing aid profiles 218 or 270, respectively. In this instance, hearing aid 202 may switch from a first hearing aid profile to a second hearing aid profile based on environmental sound conditions or based on user input. In response to switching to the second hearing aid profile, the currently applied hearing correction filter is applied to the second hearing aid profile to attenuate the second hearing aid profile. Thus, the progressive hearing adjustment can continue across different hearing aid profiles over time until the user's hearing is fully compensated by hearing aid 202.

In one embodiment, processor 210 or processor 260 can divide a selected hearing aid profile into increments, beginning with a zero-adjustment point corresponding to the user's uncompensated hearing loss and ending at a fully-compensated hearing level, such as that provided by unattenuated application of a selected hearing aid profile. In the alternative the incremental hearing corrections 224 may be programmed by a hearing instrument specialist, audiologist, or ENT (ear noise and throat doctor) or generated by a remote computing device and downloaded onto computing device 252 via the network 230 (such as the Internet). In this instance, the number of incremental hearing corrections 224 or 276 can be a pre-determined number or can be determined based on an incremental correction limit per increment. In this latter instance, the number of increments can be determined by the magnitude of the correction; therefore, the number of increments varies based on the magnitude of the hearing correction provided by the hearing aid profile relative to a zero-adjustment baseline. In another embodiment, hearing correction filters 222 or 272 can be generated by a hearing instrument specialist, audiologist, or ENT or downloaded via the network 230. Hearing correction filters 222 or 272 may be attenuation filters designed to incrementally attenuate or dampen the adjustment provided by a selected hearing aid profile, such that each hearing correction filter provides incrementally less attenuation than a previous hearing correction filter in the sequence until the hearing aid profile is applied fully. In this instance, application of a hearing correction filter to a hearing aid profile produces an incremental hearing correction.

Once the filters are generated, processor 210 selectively applies a selected one of the incremental hearing correction filters to the selected hearing aid profile for a period of time before advancing to a next incremental hearing correction filter in the sequence, providing incremental hearing adjustments from the uncompensated baseline to the fully-compensated hearing experience provided by the unfiltered hearing aid profile. Thus, hearing aid 202 eases the user into the desired hearing correction over a period of time, reducing the shock to the user and reducing the probability that the user will reject hearing aid 202 altogether.

In general, either hearing aid 202 or computing device 252 may monitor the incremental hearing correction steps. In an embodiment, processor 210 in hearing aid 202 will monitor a clock signal in hearing aid 202 and count the number of cycles in memory 204. Once the number of clock cycles exceeds a preset limit (or threshold), processor 210 is triggered to apply a next hearing correction filter in the sequence and to reset the clock counter. In another embodiment, processor 210 may generate a trigger based on a pre-defined calendar schedule, such as a number of days or weeks or a specific date. In an alternative embodiment, processor 260 in computing device 252 generates triggers (either automatically or initiated by the user through display interface 258 and input interface 256) and sends a signal including the trigger to hearing aid 202 through the communication channel, causing processor 210 to apply the incremental hearing correction filter to the selected hearing aid profile.

Once a trigger is received by hearing aid 202, processor 210 obtains the next incremental hearing filter either from one or more incremental hearing filters 220 in memory 204 or from a signal received from computing device 352. In some instances, hearing aid 202 may signal computing device 252 to retrieve the incremental hearing filter 276 from one or more incremental hearing filters 376 in memory 354. Once processor 210 has received the next incremental hearing filter, processor 210 applies it to the selected hearing aid profile to generate a set of instructions to shape sound input received from microphone 212 to produce a modulated output signal for reproduction for the user by speaker 214.

While FIG. 2 depicts a block diagram of one possible system for providing an incremental hearing correction using hearing correction profiles, such a system can be used to implement a wide array of methods. One possible example of a method of applying a hearing correction setting is described below with respect to FIG. 3.

Figure 3:
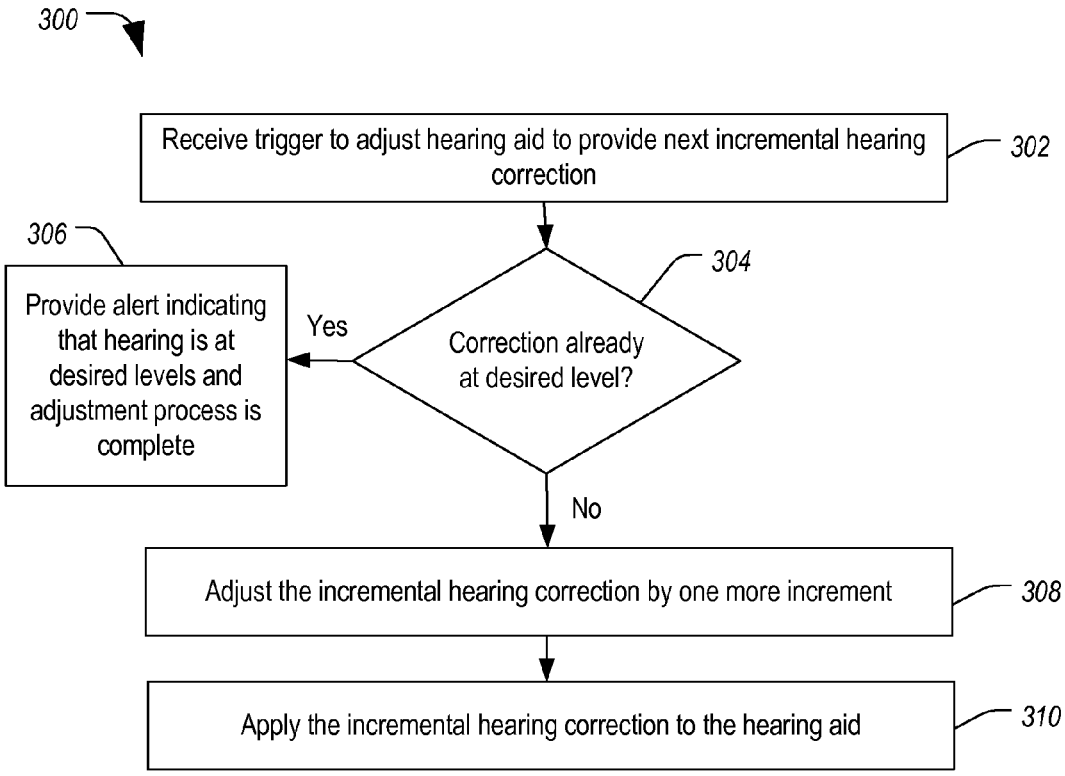
FIG. 3 is a flow diagram of an embodiment of a method for incrementally adjusting the hearing correction of a hearing aid.

FIG. 3 is a flow diagram of an embodiment of a method 300 for incrementally adjusting the hearing correction of a hearing aid. At 302, a trigger is received to adjust a hearing aid to apply the next incremental hearing correction. The next incremental hearing correction represents a next incremental hearing correction in a progressive sequence of incremental hearing corrections that can be used to gradually adjust the user's hearing aid experience from an uncompensated sound experience to a fully compensated sound experience. The incremental hearing correction may be a hearing correction profile executed by the processor in the hearing aid or a hearing correction filter applied to the hearing aid profile executed by the processor in the hearing aid. Alternatively, the hearing correction settings may be stored as incremental hearing corrections and/or generated by a computing device and sent to the hearing aid as part of the trigger. The trigger is a command executable by a processor in the hearing aid. In some instances, the trigger may also include the next incremental hearing correction setting or an identifier thereof to allow the hearing aid to retrieve the next incremental hearing correction from memory. Either the hearing aid or a computing device may keep a record of which is the next incremental hearing correction setting to apply when a trigger is received. A trigger may be generated by a circuit within the hearing aid, by a process executing on the hearing aid, or by an external source, such as the computing device.

Several methods of generating a trigger are contemplated. In one embodiment, the processor in the hearing aid or the processor in the computing device monitors clock cycles and record the number of cycles in memory. Once the number of clock cycles exceeds a preset limit, the process generates a trigger and resets the clock counter to zero, providing a periodic signal, such as every 10 hours. In a second embodiment, the processor may generate a trigger based on a calendar. For example, a trigger may be generated every day or every week. In another embodiment, the period of time is programmable by the user. In still another embodiment, the period is preset by the audiologist or hearing health professional. In yet another embodiment, the trigger may be user initiated. For example, the user may utilize an external device, such as the computing device to trigger the next incremental hearing correction setting via a user interface. The user selection could then be communicated to the hearing aid.

Proceeding to 304, the processor in the hearing aid determines if the hearing correction setting is already compensating the user at a desired level of hearing. If the hearing correction is already at a desired level, method 300 proceeds to 306 and the processor in the hearing aid provides an user alert indicating to the user that hearing is at desired levels and that the adjustment process is complete. In an example, the alert may be an audible alert reproduced through a speaker of hearing aid. Alternatively, the alert may be sent to the computing device for display on the display interface. In yet another embodiment, the alert may be intended to notify the processor in the hearing aid or the processor in the computing device that the progressive adjustment process is complete, no further adjustments are needed or should be scheduled, and that the automatic adjustment process may terminate. In some instances, the alert may configure a register setting that disables the progressive (incremental) adjustment.

If at 304 the processor determines that the current hearing correction setting is not at the desired levels, the method 300 proceeds to 308 and a next incremental hearing correction setting is used to adjust the hearing correction by one or more increments. The incremental hearing correction setting may be retrieved from a memory on hearing aid, may be dynamically generated by applying a next hearing correction filter in a sequence of filters to the selected hearing aid profile, or may be included in the trigger received from the computing device.

Continuing to 310, the processor in the hearing aid applies the incremental hearing correction to the hearing aid. In an example, the processor in the hearing aid uses the incremental hearing correction to shape the input sound received at a microphone to produce a shaped output signal, which is at an intermediate output level and which will be played to the user through a speaker.

In some instances, it may be desirable to provide the incremental adjustment during an initial period after the user begins using the hearing aid and then to disable to incremental adjustment capability thereafter. An example of a method for providing the incremental adjustment during a first period and for disabling the incremental adjustment after the first period is described below with respect to FIG. 4.

Figure 4:
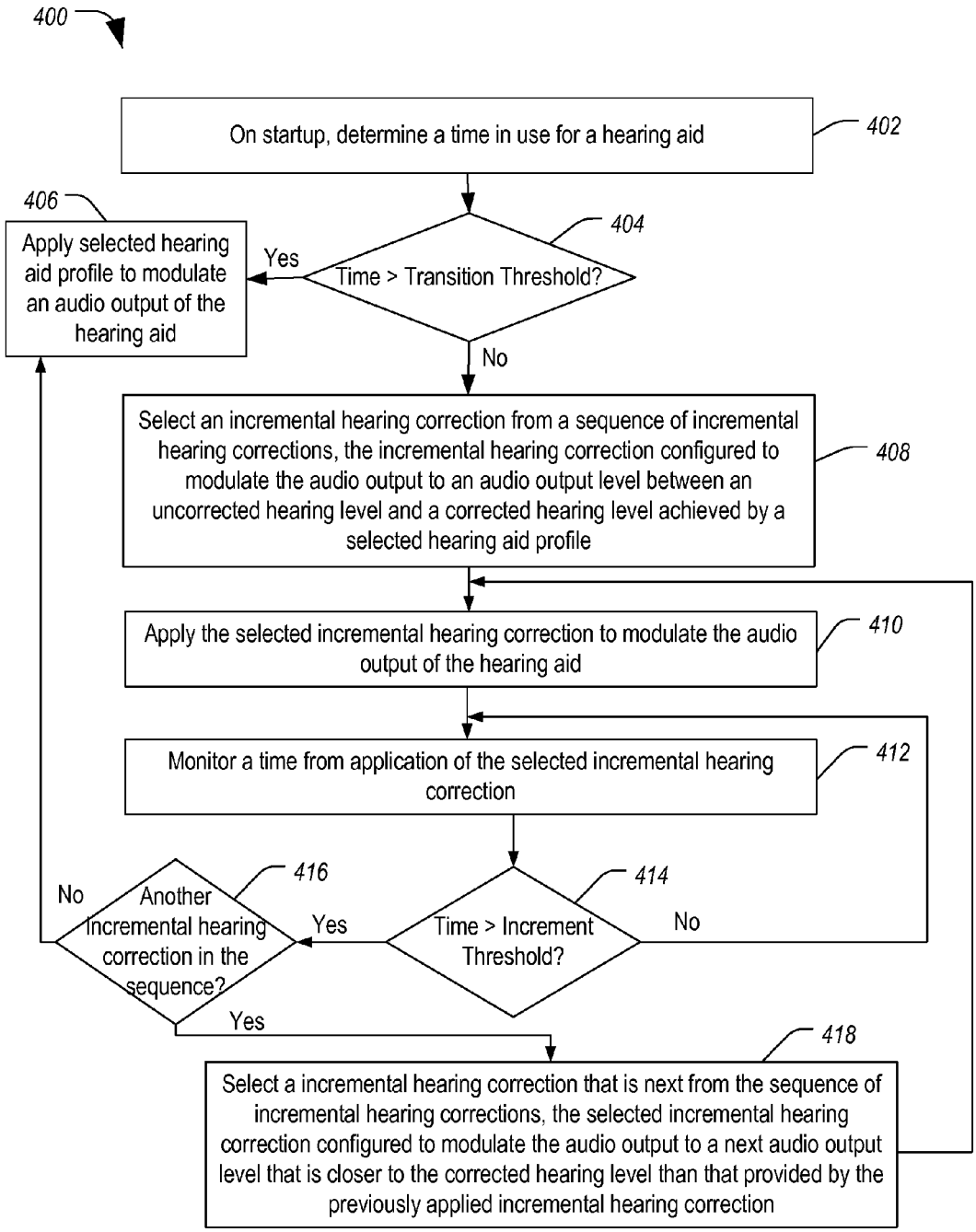
FIG. 4 is a flow diagram of a second embodiment of a method for incrementally adjusting the hearing correction of a hearing aid.

FIG. 4 is a flow diagram of a second embodiment of a method 400 for incrementally adjusting the hearing correction of a hearing aid. At 402, on startup, the hearing aid determines a. time in use, such as based on a number of clock cycles. After transition period, the user will have become accustomed to the hearing correction provided by the hearing aid, and will no longer need the incremental adjustments. The period of time may be configured by a user, determined based on the amount of correction required, programmed by a hearing health professional, or pre-programmed by the device manufacturer, At 404, if the time exceeds a transition threshold, the method 400 advances to 406 and a processor of the hearing aid applies a selected hearing aid profile to modulate an audio output of the hearing aid. Otherwise, at 404, if the time does not exceed the transition threshold, the method 400 advances to 408 and an incremental hearing correction is selected from a sequence of incremental hearing corrections, where the incremental hearing correction is configured to modulate the audio output to an audio output level between an uncorrected hearing level and a corrected hearing level achieved by applying the selected hearing aid profile.

Moving to 410, the processor of the hearing aid applies the selected incremental hearing correction to audio signals to modulate the audio output of the hearing aid. Continuing to 412, a time from application of the selected incremental hearing correction is monitored. At 414, if the time does not exceed an increment threshold, the method 400 returns to 412 and time continues to be monitored.

At 414, if the time exceeds the increment threshold, the method 400 proceeds to 416. At 416, if there is no other incremental hearing correction in the sequence, the method 400 continues to 406 and the selected hearing aid profile is applied. Otherwise, at 414, if there is another incremental hearing correction, the method 400 advances to 418 and an incremental hearing correction that is next is selected from the sequence, where the selected incremental hearing correction is configured to modulate the audio output to a next audio output level that is closer to the corrected level than that provided by the previously applied incremental hearing correction. The method 400 then returns to 410 and the selected incremental hearing correction is applied to modulate the audio output of the hearing aid.

In conjunction with the systems and methods described above with respect to FIGS. 2-4, a system is disclosed that allows a hearing aid to incrementally adjust the hearing correction for a user over a period of time to ease the user to a "normal" hearing level. As described above, a sequence of incremental hearing corrections are applied over a period of time to progressively advance the quality of the user's hearing from an uncompensated state to a normal hearing level.

Although the present invention has been described with reference to preferred embodiments, workers skilled in the art will recognize that changes may be made in form and detail without departing from the scope of the invention.

What is claimed is:

1. A hearing aid comprising:

a microphone to convert sound into electrical signals;

a speaker to output audible sound;

a processor; and a memory to store instructions, which when executed by the processor, cause the processor to:

receive a selection of a hearing aid profile from a plurality of hearing aid profiles, the selected hearing aid profile configured to modulate the electrical signals to a level to compensate for a hearing impairment of a user;

apply a first one of a sequence of incremental hearing correction filters to the modulated electrical signals to produce a modulated output signal to reduce the amplitude of the modulated electrical signals produced by the selected hearing aid profile to a first level that is less than a level to compensate for the hearing impairment of the user;

select a second one of the sequence of incremental hearing correction filters in response to receiving a trigger, the second one being designated to follow the first one in the sequence of incremental hearing correction filters and to reduce the amplitude of the modulated electrical signals produced by the selected hearing aid profile to a second level that is greater than the first level and less than the level to compensate for the hearing impairment of the user; and cause the speaker to output an alert when a final one of the sequence of incremental hearing correction filters is being applied, the final one being the last hearing correction filter of the sequence of incremental hearing correction filters.

2. The hearing aid of claim 1, wherein each of the incremental hearing correction filters comprises a collection of acoustic configuration settings configured to modulate the electrical signal to a level that is within a range between an uncompensated hearing level of the user and the level to compensate for the hearing impairment of the user.

3. The hearing aid of claim 1, further comprising:

a transceiver coupled to the processor and configurable to communicate with a computing device through a communication channel during operation, the transceiver to receive a signal from the computing device and to provide the signal to the processor;

wherein the processor applies the selected one of the sequence of incremental hearing correction filters in response to receiving the signal.

4. The hearing aid of claim 3, wherein the signal includes the selected one of the sequence of incremental hearing correction filters.

5. The hearing aid of claim 3, further comprising a memory to store the sequence of incremental hearing correction filters; and wherein the signal includes an indicator identifying the selected one of the incremental hearing correction filters within the sequence; and wherein, in response to receiving the signal, the processor retrieves the selected one of the incremental hearing correction filters from the memory and applies the selected one to the modulated electrical signals.

6. A non-transitory computer-readable device comprising instructions that, when executed by a processor, cause the processor to:

select a hearing aid profile from a plurality of hearing aid profiles, the selected hearing aid profile configured to modulate an audio signal to a level to compensate for a hearing impairment of a user;

apply a first hearing correction filter to the selected hearing aid profile to reduce the amplitude of the modulated audio signal produced by the selected hearing aid profile to a first level that is less than the level to compensate for the hearing impairment of the user;

determine an amount of time during which the first hearing correction filter is applied; and selectively apply a second hearing correction filter to the selected hearing aid profile to reduce the amplitude of the modulated audio signal produced by the selected hearing aid profile to a second level that is greater than the first level and less than the level to compensate for the hearing impairment of the user when the amount of time exceeds a pre-determined threshold, the pre-determined threshold is programmable by the user.

7. The computer-readable device of claim 6, wherein the pre-determined threshold is configurable by the user.

8. The computer-readable device of claim 6, further comprising instructions that, when executed by the processor, cause the processor to receive the first hearing correction filter and the second hearing correction filter from a transceiver configured to communicatively couple to a computing device during operation.

9. The non-transitory computer-readable device of claim 6, further comprising instructions that, when executed by the processor, cause the processor to dynamically generate the first hearing correction filter and the second hearing correction filter based on at least one of the hearing impairment of the user and a hearing aid profile including a collection of acoustic configuration settings for producing the modulated output signal at the corrected hearing level.

10. A computing device comprising:

a transceiver configurable to communicate with a hearing aid through a communication channel;

a processor coupled to the transceiver; and a memory coupled to the processor and configured to store instructions that, when executed by the processor, cause the processor to:

generate a sequence of incremental hearing correction filters based at least in part on a magnitude of a difference between a hearing aid profile and a hearing loss level associated with a user of the hearing aid, the sequence of incremental hearing correction filters including at least a first hearing correction filter and a second hearing correction filter;

provide a first signal related to the first hearing correction filter of the sequence of incremental hearing correction filters to the hearing aid through the communication channel; and provide a second signal related to a second hearing correction filter of the sequence of incremental hearing correction filters to the hearing aid in response to receiving a selection of the second hearing correction filter from a user of the hearing aid.

11. The computing device of claim 10, wherein the memory stores further instructions that, when executed by the processor, cause the processor to:

initiate a timer to determine the period of time;

iteratively select and provide selection signals related to subsequent ones of the incremental hearing correction filters from the sequence to the hearing aid when the period of time exceeds the threshold time increment; and reset and restart the timer when each of the subsequent ones of the incremental hearing correction filters is provided to the hearing aid.

12. The computing device of claim 10, wherein the threshold time increment varies with each of the incremental hearing correction filters.

13. The computing device of claim 10, wherein the first signal and the second signal comprise triggers to initiate an adjustment to a currently selected incremental hearing correction filter executing on the hearing aid.

14. The computing device of claim 10, wherein the first signal and the second signal include the first hearing correction filter and the second hearing correction filter.

15. The computing device of claim 10, wherein the memory further comprises instructions that, when executed by the processor, cause the processor to progressively advance through the sequence of the incremental hearing correction filters by providing each of the incremental hearing correction filter to the hearing aid, one at a time, over a sequence of time increments to provide a progressive hearing aid adjustment from an uncompensated hearing level to a corrected hearing level to aid in the user in acclimating to the hearing aid.

16. The hearing aid of claim 1, further comprising instructions that, when executed by the processor, cause the processor to generate the sequence of incremental hearing correction filters based at least in part on a magnitude of a difference between a hearing aid profile and a hearing loss level associated with the user of the hearing aid, the sequence of incremental hearing correction filters including at least the first hearing correction filter and the second hearing correction filter.

17. The non-transitory computer-readable device of claim 6, further comprising instructions that, when executed by the processor, cause the processor to generate the sequence of incremental hearing correction filters based at least in part on a magnitude of a difference between a hearing aid profile and a hearing loss level associated with the user of the hearing aid, the sequence of incremental hearing correction filters including at least the first hearing correction filter and the second hearing correction filter.

18. The hearing aid of claim 1, further comprising instructions that, when executed by the processor, cause the processor to:

determine an amount of time during which the first hearing correction filter is applied; and apply the second hearing correction filter when the amount of time exceeds a pre-determined threshold.

19. The hearing aid of claim 18, wherein the pre-determined threshold is adjustable by the user.

20. The computer-readable device of claim 10, further comprising instructions that, when executed by the processor, cause the processor to receive:

a selection of a hearing aid profile; and provide the hearing aid profile to the hearing aid.

* * * * *